US008985200B2

(12) United States Patent
Rodgers et al.

(10) Patent No.: US 8,985,200 B2
(45) Date of Patent: Mar. 24, 2015

(54) SENSING SHOCK DURING WELL PERFORATING

(75) Inventors: John Rodgers, Roanoke, TX (US); Marco Serra, Winterthur (CH); David Swenson, Crossroads, TX (US); Eugene Linyaev, Houston, TX (US); Timothy S. Glenn, Dracut, MA (US); Cam Le, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/304,075

(22) Filed: Nov. 23, 2011

(65) Prior Publication Data

US 2012/0152519 A1 Jun. 21, 2012

(30) Foreign Application Priority Data

Dec. 17, 2010 (WO) ..... PCT/US2010/061102

(51) Int. Cl.
*E21B 43/1185* (2006.01)
*E21B 47/01* (2012.01)
*E21B 43/119* (2006.01)

(52) U.S. Cl.
CPC ..... *E21B 47/01* (2013.01); *E21B 43/119* (2013.01)
USPC ..... 166/66

(58) Field of Classification Search
CPC ... E21B 43/1185; E21B 47/00; E21B 43/116; E21B 43/11857; E21B 43/263
USPC ..... 175/1–4.6; 166/297, 298
See application file for complete search history.

(56) References Cited

U.S. PATENT DOCUMENTS

| | | | |
|---|---|---|---|
| 472,342 | A | 4/1892 | Draudt |
| 1,073,850 | A | 9/1913 | Greer |
| 2,440,452 | A | 4/1948 | Smith |
| 2,833,213 | A | 5/1958 | Udry |
| 2,980,017 | A | 4/1961 | Castel |
| 3,057,296 | A | 10/1962 | Silverman |
| 3,128,825 | A | 4/1964 | Blagg |
| 3,143,321 | A | 8/1964 | McGehee et al. |
| 3,151,891 | A | 10/1964 | Sanders |

(Continued)

FOREIGN PATENT DOCUMENTS

| | | | |
|---|---|---|---|
| EP | 2065557 | A1 | 6/2009 |
| GB | 2406870 | A | 4/2005 |

(Continued)

OTHER PUBLICATIONS

Halliburton; "AutoLatch Release Gun Connector", Special Applications 6-7, received Jan. 19, 2011, 1 page.

(Continued)

*Primary Examiner* — Shane Bomar
*Assistant Examiner* — Kipp Wallace
(74) *Attorney, Agent, or Firm* — Smith IP Services, P.C.

(57) ABSTRACT

A shock sensing tool for use with well perforating can include a generally tubular structure which is fluid pressure balanced, at least one strain sensor which senses strain in the structure, and a pressure sensor which senses pressure external to the structure. A well system can include a perforating string including multiple perforating guns and at least one shock sensing tool, with the shock sensing tool being interconnected in the perforating string between one of the perforating guns and at least one of: a) another of the perforating guns, and b) a firing head.

21 Claims, 7 Drawing Sheets

(56) References Cited

U.S. PATENT DOCUMENTS 3,208,378 A 9/1965 Boop
3,216,751 A 11/1965 Der Mott
3,381,983 A 5/1968 Hanes
3,394,612 A 7/1968 Bogosoff et al.
3,414,071 A 12/1968 Alberts
3,653,468 A 4/1972 Marshall
3,687,074 A 8/1972 Andrews et al.
3,779,591 A 12/1973 Rands
3,923,105 A 12/1975 Lands, Jr.
3,923,106 A 12/1975 Bosse-Platiere
3,923,107 A 12/1975 Dillard
3,971,926 A 7/1976 Gau et al.
4,269,063 A 5/1981 Escaron et al.
4,319,526 A 3/1982 DerMott
4,346,795 A 8/1982 Herbert
4,409,824 A 10/1983 Salama et al.
4,410,051 A 10/1983 Daniel et al.
4,419,933 A 12/1983 Kirby et al.
4,480,690 A 11/1984 Vann
4,575,026 A 3/1986 Brittain et al.
4,598,776 A 7/1986 Stout
4,612,992 A * 9/1986 Vann et al. ..... 166/297
4,619,333 A 10/1986 George
4,637,478 A 1/1987 George
4,679,669 A 7/1987 Kalb et al.
4,685,708 A 8/1987 Conner et al.
4,693,317 A 9/1987 Edwards et al.
4,694,878 A 9/1987 Gambertoglio
4,764,231 A 8/1988 Slawinski et al.
4,817,710 A 4/1989 Edwards et al.
4,830,120 A 5/1989 Stout
4,842,059 A 6/1989 Tomek
4,884,829 A 12/1989 Funk et al.
4,901,802 A 2/1990 George et al.
4,913,053 A 4/1990 McPhee
4,971,153 A 11/1990 Rowe et al.
5,027,708 A 7/1991 Gonzalez et al.
5,044,437 A 9/1991 Wittrisch
5,078,210 A 1/1992 George
5,088,557 A 2/1992 Ricles et al.
5,092,167 A 3/1992 Finley et al.
5,103,912 A 4/1992 Flint
5,107,927 A 4/1992 Whiteley et al.
5,109,355 A 4/1992 Yuno
5,117,911 A 6/1992 Navarette et al.
5,131,470 A 7/1992 Miszewski et al.
5,133,419 A 7/1992 Barrington
5,161,616 A 11/1992 Colla
5,188,191 A 2/1993 Tomek
5,216,197 A 6/1993 Huber et al.
5,287,924 A 2/1994 Burleson et al.
5,341,880 A 8/1994 Thorstensen et al.
5,343,963 A * 9/1994 Bouldin et al. ..... 175/27
5,351,791 A 10/1994 Rosenzweig
5,366,013 A 11/1994 Edwards et al.
5,421,780 A 6/1995 Vukovic
5,490,694 A 2/1996 Shumway
5,529,127 A 6/1996 Burleson et al.
5,547,148 A 8/1996 Del Monte et al.
5,598,894 A 2/1997 Burleson et al.
5,603,379 A 2/1997 Henke et al.
5,662,166 A 9/1997 Shammai
5,667,023 A 9/1997 Harrell et al.
5,671,955 A 9/1997 Shumway
5,774,420 A 6/1998 Heysse et al.
5,813,480 A 9/1998 Zaleski, Jr. et al.
5,823,266 A 10/1998 Burleson et al.
5,826,654 A 10/1998 Adnan et al.
5,868,200 A 2/1999 Bryant et al.
5,957,209 A 9/1999 Burleson et al.
5,964,294 A 10/1999 Edwards et al.
5,992,523 A 11/1999 Burleson et al.
6,012,015 A 1/2000 Tubal
6,021,377 A 2/2000 Dubinsky et al.
6,068,394 A 5/2000 Dublin, Jr.
6,078,867 A 6/2000 Plumb et al.
6,098,716 A 8/2000 Hromas et al.
6,135,252 A 10/2000 Knotts
6,173,779 B1 1/2001 Smith
6,216,533 B1 4/2001 Woloson et al.
6,230,101 B1 5/2001 Wallis
6,283,214 B1 9/2001 Guinot et al.
6,308,809 B1 10/2001 Reid et al.
6,371,541 B1 4/2002 Pedersen
6,394,241 B1 5/2002 Desjardins et al.
6,397,752 B1 6/2002 Yang et al.
6,408,953 B1 6/2002 Goldman et al.
6,412,415 B1 7/2002 Kothari et al.
6,412,614 B1 7/2002 Lagrange et al.
6,450,022 B1 9/2002 Brewer
6,454,012 B1 9/2002 Reid
6,457,570 B2 10/2002 Reid et al.
6,484,801 B2 11/2002 Brewer et al.
6,543,538 B2 4/2003 Tolman et al.
6,550,322 B2 4/2003 Sweetland et al.
6,595,290 B2 7/2003 George et al.
6,672,405 B2 1/2004 Tolman et al.
6,674,432 B2 1/2004 Kennon et al.
6,679,323 B2 1/2004 Vargervik et al.
6,679,327 B2 1/2004 Sloan et al.
6,684,949 B1 2/2004 Gabler et al.
6,684,954 B2 2/2004 George
6,708,761 B2 3/2004 George et al.
6,752,207 B2 6/2004 Danos et al.
6,810,370 B1 10/2004 Watts, III
6,826,483 B1 11/2004 Anderson
6,832,159 B2 12/2004 Smits et al.
6,842,725 B1 1/2005 Sarda
6,868,920 B2 3/2005 Hoteit et al.
7,000,699 B2 2/2006 Yang et al.
7,006,959 B1 2/2006 Huh et al.
7,044,219 B2 5/2006 Mason et al.
7,114,564 B2 10/2006 Parrott et al.
7,121,340 B2 10/2006 Grove et al.
7,139,689 B2 11/2006 Huang
7,147,088 B2 12/2006 Reid et al.
7,165,612 B2 1/2007 McLaughlin
7,178,608 B2 2/2007 Mayes et al.
7,195,066 B2 3/2007 Sukup et al.
7,234,517 B2 6/2007 Streich et al.
7,246,659 B2 7/2007 Fripp et al.
7,260,508 B2 8/2007 Lim et al.
7,278,480 B2 10/2007 Longfield et al.
7,387,160 B2 6/2008 O'Shaughnessy et al.
7,387,162 B2 6/2008 Mooney, Jr. et al.
7,393,019 B2 7/2008 Taga et al.
7,503,403 B2 3/2009 Jogi et al.
7,509,245 B2 3/2009 Siebrits et al.
7,533,722 B2 5/2009 George et al.
7,600,568 B2 10/2009 Ross et al.
7,603,264 B2 10/2009 Zamora et al.
7,640,986 B2 1/2010 Behrmann et al.
7,699,356 B2 4/2010 Bucher et al.
7,721,650 B2 5/2010 Barton et al.
7,721,820 B2 5/2010 Hill et al.
7,722,089 B2 5/2010 Nauer
7,762,331 B2 7/2010 Goodman et al.
7,770,662 B2 8/2010 Harvey et al.
7,789,152 B2 9/2010 Langeslag
7,806,035 B2 * 10/2010 Kaiser et al. ..... 89/1.15
7,954,860 B2 6/2011 Suzuki
8,126,646 B2 2/2012 Grove et al.
8,136,608 B2 3/2012 Goodman
2002/0088620 A1 7/2002 Lerche et al.
2002/0121134 A1 * 9/2002 Sweetland et al. ..... 73/152.51
2002/0189809 A1 12/2002 Nguyen et al.
2003/0000699 A1 1/2003 Hailey, Jr.
2003/0062169 A1 4/2003 Marshall
2003/0089497 A1 5/2003 George et al.
2003/0150646 A1 8/2003 Brooks et al.
2004/0045351 A1 3/2004 Skinner
2004/0104029 A1 * 6/2004 Martin ..... 166/298
2004/0140090 A1 7/2004 Mason et al.
2006/0048940 A1 3/2006 Hromas et al.

(56) References Cited

U.S. PATENT DOCUMENTS

| | | | | |
|---|---|---|---|---|
| 2006/0070734 | A1 | 4/2006 | Zillinger et al. | |
| 2006/0118297 | A1 | 6/2006 | Finci et al. | |
| 2006/0243453 | A1 | 11/2006 | McKee | |
| 2007/0101808 | A1 | 5/2007 | Irani et al. | |
| 2007/0162235 | A1 | 7/2007 | Zhan et al. | |
| 2007/0193740 | A1* | 8/2007 | Quint | 166/250.07 |
| 2007/0214990 | A1 | 9/2007 | Barkley et al. | |
| 2007/0283751 | A1 | 12/2007 | Van Der Spek | |
| 2008/0041597 | A1 | 2/2008 | Fisher et al. | |
| 2008/0149338 | A1 | 6/2008 | Goodman et al. | |
| 2008/0202325 | A1 | 8/2008 | Bertoja et al. | |
| 2008/0216554 | A1 | 9/2008 | McKee | |
| 2008/0245255 | A1 | 10/2008 | Barton et al. | |
| 2008/0262810 | A1 | 10/2008 | Moran et al. | |
| 2008/0314582 | A1 | 12/2008 | Belani et al. | |
| 2009/0013775 | A1 | 1/2009 | Bogath et al. | |
| 2009/0071645 | A1 | 3/2009 | Kenison et al. | |
| 2009/0084535 | A1 | 4/2009 | Bertoja et al. | |
| 2009/0151589 | A1 | 6/2009 | Henderson et al. | |
| 2009/0159284 | A1 | 6/2009 | Goodman | |
| 2009/0168606 | A1* | 7/2009 | Lerche et al. | 367/197 |
| 2009/0182541 | A1 | 7/2009 | Crick et al. | |
| 2009/0223400 | A1 | 9/2009 | Hill et al. | |
| 2009/0241658 | A1 | 10/2009 | Irani et al. | |
| 2009/0272529 | A1 | 11/2009 | Crawford | |
| 2009/0276156 | A1 | 11/2009 | Kragas et al. | |
| 2009/0294122 | A1 | 12/2009 | Hansen et al. | |
| 2010/0000789 | A1 | 1/2010 | Barton et al. | |
| 2010/0011943 | A1* | 1/2010 | Quinn et al. | 89/1.1 |
| 2010/0037793 | A1 | 2/2010 | Lee et al. | |
| 2010/0051265 | A1* | 3/2010 | Hurst et al. | 166/250.01 |
| 2010/0085210 | A1 | 4/2010 | Bonavides et al. | |
| 2010/0132939 | A1 | 6/2010 | Rodgers | |
| 2010/0133004 | A1* | 6/2010 | Burleson et al. | 175/2 |
| 2010/0147519 | A1 | 6/2010 | Goodman | |
| 2010/0200235 | A1 | 8/2010 | Luo et al. | |
| 2010/0230105 | A1 | 9/2010 | Vaynshteyn | |
| 2011/0088901 | A1 | 4/2011 | Watters et al. | |
| 2012/0085539 | A1 | 4/2012 | Tonnessen et al. | |
| 2012/0152542 | A1 | 6/2012 | Le | |
| 2012/0152614 | A1 | 6/2012 | Rodgers et al. | |
| 2012/0152615 | A1 | 6/2012 | Rodger et al. | |
| 2012/0152616 | A1 | 6/2012 | Rodger et al. | |
| 2012/0158388 | A1 | 6/2012 | Rodger et al. | |
| 2012/0160478 | A1 | 6/2012 | Todd et al. | |
| 2012/0241169 | A1 | 9/2012 | Hales et al. | |
| 2012/0241170 | A1 | 9/2012 | Hales et al. | |

FOREIGN PATENT DOCUMENTS

| | | | |
|---|---|---|---|
| WO | 2004076813 | A1 | 9/2004 |
| WO | 2004099564 | | 11/2004 |
| WO | 2007056121 | A1 | 5/2007 |

OTHER PUBLICATIONS

Halliburton; "Body Lock Ring", Mechanical Downhole: Technology Transfer, dated Oct. 10, 2001, 4 pages.

Starboard Innovations, LLC; "Downhole Mechanical Shock Absorber", patent and prior art search results, Preliminary Report, dated Jul. 8, 2010, 22 pages.

Carlos Baumann, Harvey Williams, and Schlumberger; "Perforating Wellbore Dynamics and Gunshock in Deepwater TCP Operations", Product informational presentation, IPS-10-018, received May 11, 2011, 28 pages.

Schlumberger; "SXVA Explosively Initiated Vertical Shock Absorber", product paper 06-WT-066, dated 2007, 1 page.

International Search Report with Written Opinion issued Dec. 27, 2011 for PCT Patent Application No. PCT/US11/046955, 8 pages.

International Search Report with Written Opinion issued Jul. 28, 2011 for International Application No. PCT/US10/61104, 8 pages.

International Search Report with Written Opinion issued Nov. 22, 2011 for International Application No. PCT/US11/029412, 9 pages.

International Search Report with Written Opinion issued Jul. 28, 2011 for International Application No. PCT/US10/061107, 9 pages.

International Search Report issued Jul. 28, 2011 for International Application No. PCT/US10/61102, 8 pages.

International Written Opinion issued Jul. 28, 2011 for International Application No. PCT/US10/61102, 3 pages.

Office Action issued Jun. 11, 2013 for U.S. Appl. No. 13/493,327, 23 pages.

Office Action issued Jun. 20, 2013 for U.S. Appl. No. 13/533,600, 38 pages.

Specification and Drawings for U.S. Appl. No. 13/495,035, filed Jun. 13, 2012, 37 pages.

Specification and Drawings for U.S. Appl. No. 13/493,327, filed Jun. 11, 2012, 30 pages.

Office Action issued Jun. 6, 2012 for U.S. Appl. No. 13/325,909, 35 pages.

Halliburton; "ShockPro Shockload Evaluation Service", product article, received Nov. 16, 2010, 2 pages.

Halliburton; "ShockPro Shockload Evaluation Service", H03888, dated Jul. 2007, 2 pages.

Strain Gages; "Positioning Strain Gages to Monitor Bending, Axial, Shear, and Torsional Loads", pp. E-5 to E-6, dated 2012, 2 pages.

B. Grove, et al.; "Explosion-Induced Damage to Oilwell Perforating Gun Carriers", Structures Under Shock and Impact IX, vol. 87, ISSN 1743-3509, SU060171, dated 2006, 12 pages.

WEM; "Well Evaluation Model", product brochure, received Mar. 2, 2010, 2 pages.

Endevco; "Problems in High-Shock Measurement", MEGGITT brochure TP308, dated Jul. 2007, 9 pages.

Office Action issued Jun. 29, 2011 for U.S. Appl. No. 13/325,866, 30 pages.

Specification and Drawings for U.S. Appl. No. 13/533,600, filed Jun. 26, 2012, 30 pages.

International Search Report with Written Opinion issued Nov. 30, 2011 for PCT/US11/036686, 10 pages.

Office Action issued Sep. 6, 2012 for U.S. Appl. No. 13/495,035, 28 pages.

Specification and drawing for U.S. Appl. No. 13/585,846, filed Aug. 25, 2012, 45 pages.

Office Action issued Oct. 1, 2012 for U.S. Appl. No. 13/325,726, 20 pages.

Australian Examination Report issued Sep. 21, 2012 for AU Patent Application No. 2010365400, 3 pages.

Office Action issued Oct. 23, 2012 for U.S. Appl. No. 13/325,866, 35 pages.

Office Action issued Nov. 19, 2012 for U.S. Appl. No. 13/325,909, 43 pages.

Office Action issued Jun. 13, 2012 for U.S. Appl. No. 13/377,148, 38 pages.

Office Action issued Jul. 20, 2012 for U.S. Appl. No. 13/758,781, 32 pages.

Office Action issued Aug. 2, 2012 for U.S. Appl. No. 13/210,303, 35 pages.

Office Action issued Jul. 26, 2012 for U.S. Appl. No. 13/325,726, 52 pages.

Office Action issued Sep. 13, 2013 for U.S. Appl. No. 13/210,303, 25 pages.

Mexican Office Action issued Sep. 2, 2013 for Mexican Patent Application No. MX/a/2011/011468, 3 pages.

J.F. Schatz, et al.; "High-Speed Download Memory Recorder and Software Used to Design and COnfirm Perforating/Propellant Behavior and Formation Fracturing", Society of Petroleum Engineers Inc., SPE56434 dated Oct. 3-6, 1999, 9 pages.

Office Action issued Dec. 12, 2012 for U.S. Appl. No. 13/493,327, 75 pages.

Office Action issued Dec. 14, 2012 for U.S. Appl. No. 13/495,035, 19 pages.

Office Action issued Dec. 18, 2012 for U.S. Appl. No. 13/533,600, 48 pages.

Australian Examination Report issued Jan. 3, 2013 for Australian Patent Application No. 2010365400, 3 pages.

Office Action issued Feb. 12, 2013 for U.S. Appl. No. 13/633,077, 31 pages.

(56) References Cited

OTHER PUBLICATIONS

Special Devices, Inc.; "Electronic Initiation System: The SDI Electronic Initiation System", online product brochure from www.specialdevices.com, received May 18, 2011, 4 pages.
International Search Report with Written Opinion issued Feb. 9, 2012 for PCT Patent Application No. PCT/US11/050401, 8 pages.
Patent Application, filed Apr. 29, 2011, Serial No. PCT/US11/034690, 35 pages.
Drawings, filed 29 Apr. 2011, Serial No. PCT/US11/034690, 14 figures, 10 pages.
Joseph E. Shepherd; "Structural Response of Piping to Internal Gas Detonation", article PVP2006-ICPVT11-93670, proceedings of PVP2006-ICPVT-11, dated 2006, 18 pages.
Starboard Innovations, LLC; "Internal Gun Shock Absorber", patent and prior art search results, Preliminary Report, dated May 24, 2011, 6 pages.
Starboard Innovations, LLC; "Shock Absorbing Gun Connectors", patent and prior art search results, Preliminary Report, dated May 23, 2011, 7 pages.
Starboard Innovations, LLC; "Bending Gun Connectors", patent and prior art search results, Preliminary Report, dated May 23, 2011, 7 pages.
Starboard Innovations, LLC; "Shock Sensing Sub and Shock Simulation", patent and prior art search results, Preliminary Report, dated Feb. 8, 2010, 26 pages.
Starboard Innovations, LLC; "Fast Test Application for Shock Sensing Sub", patent and prior art search results, Preliminary Report, dated Aug. 16, 2010, 26 pages.
"2010 International Perforating Symposium", Agenda, dated May 6-7, 2010, 2 pages.
IES; "Series 300: High Shock, High Speed Pressure Gauge", product brochure, dated Feb. 1, 2012, 2 pages.
IES; "Series 200: High Shock, High Speed Pressure and Acceleration Gauge", product brochure, received Feb. 11, 2010, 2 pages.
Office Action issued Jan. 27, 2012 for U.S. Appl. No. 13/210,303, 32 pages.
Office Action issued Apr. 10, 2012 for U.S. Appl. No. 13/325,726, 26 pages.
A. Blakeborough, et al.; "Novel Load Cell for Measuring Axial Force, Shear Force, and Bending Movement in Large-scale Structural Experiments", informative paper, dated Mar. 23, 2001-Aug. 30, 2001, 8 pages.
Weibing Li, et al.; "The effect of annular multi-point initiation on the formation and penetration of an explosively formed penetrator", Interntaion Journal of Impact Engineering, dated Aug. 27, 2009, 11 pages.
Sergio Murilo, et al.; "Optimization and Automation of Modeling of Flow in Perforated Oil Wells", Product Development Conference, dated 2004, 31 pages.
Terje Rudshaug, et al.; "A toolbox for improved Reservoir Management", NETool, FORCE AWTC Seminar, Apr. 21-22, 2004, 29 pages.
Frederic Bruyere, et al.; "New Practices to Enhance Perforating Results", Oilfield Review, pp. 18-35, dated Autumn 2006, 18 pages.
John F. Schatz; "Perf Breakdown, Fracturing, and Cleanup in PulsFrac", product information, dated May 2, 2007, 6 pages.
M.A. Proett; "Productivity Optimization of Oil Wells Using a New 3D Finite-Element Wellbore Inflow Model and Artificial Neural Network", Halliburton Energy Services, Inc., received Feb. 4, 2010, 17 pages.
John F. Schatz; "PulsFrac Summary Technical Description", product information, dated 2003, 8 pages.
Scott A. Ager; "IES Recorder Buildup", presentation, received Sep. 1, 2010, 59 pages.
Scott A. Ager; "IES Sensor Discussion", presentation, received Sep. 1, 2010, 38 pages.
Office Action issued Apr. 4, 2013 for U.S. Appl. No. 13/210,303, 29 pages.
Palsay, P.R.; "Stress Analysis of Drillstrings", informational presentation, dated 1994, 14 pages.
Khulief, Y.A.; "Vibration analysis of drillstrings with self-excited stick-slip oscillations", informational paper, dated Jun. 19, 2006, 19 pages.
Office Action issued Sep. 8, 2009, for U.S. Appl. No. 11/957,541, 10 pages.
Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Office Action issued May 4, 2011, for U.S. Appl. No. 11/957,541, 9 pages.
Office Action issued Apr. 21, 2011, for U.S. Appl. No. 13/008,075, 9 pages.
J.A. Regalbuto et al; "Computer Codes for Oilwell-Perforator Design", SPE 30182, dated Sep. 1997, 8 pages.
J.F. Schatz et al; "High-Speed Downhole Memory Recorder and Software Used to Design and Confirm Perforating/Propellant Behavior and Formation Fracturing", SPE 56434, dated Oct. 3-6, 1999, 9 pages.
Joseph Ansah et al; "Advances in Well Completion Design: A New 3D Finite-Element Wellbore Inflow Model for Optimizing Performance of Perforated Completions", SPE 73760, Feb. 20-21, 2002, 11 pages.
D.A. Cuthill et al; "A New Technique for Rapid Estimation of Fracture Closure Stress When Using Propellants", SPE 78171, dated Oct. 20-23, 2002, 6 pages.
J.F. Schatz et al; "High-Speed Pressure and Accelerometer Measurements Characterize Dynamic Behavior During Perforating Events in Deepwater Gulf of Mexico", SPE 90042, dated Sep. 26-29, 2004, 15 pages.
Liang-Biao Ouyang et al; "Case Studies for Improving Completion Design Through Comprehensive Well-Performance Modeling", SPE 104078, dated Dec. 5-7, 2006, 11 pages.
Liang-Biao Ouyang et al; "Uncertainty Assessment on Well-Performance Prediction for an Oil Producer Equipped With Selected Completions", SPE 106966, dated Mar. 31-Apr. 3, 2007, 9 pages.
B. Grove et al; "new Effective Stress Law for Predicting Perforation Depth at Downhole Conditions", SPE 111778, dated Feb. 13-15, 2008, 10 pages.
IES, Scott A. Ager; "IES Housing and High Shock Considerations", informational presentation, received Sep. 1, 2010, 18 pages.
IES, Scott A. Ager; Analog Recorder Test Example, informational letter, dated Sep. 1, 2010, 1 page.
IES, Scott A. Ager; "Series 300 Gauge", product information, dated Sep. 1, 2010, 1 page.
IES, Scott A. Ager; "IES Introduction", Company introduction presentation, received Sep. 1, 2010, 23 pages.
Petroleum Experts; "IPM: Engineering Software Development", product brochure, dated 2008, 27 pages.
International Search Report with Written Opinion issued Oct. 27, 2011 for PCT Patent Application No. PCT/US11/034690, 9 pages.
Kappa Engineering; "Petroleum Exploration and Product Software, Training and Consulting", product informational paper on v4.12B, dated Jan. 2010, 48 pages.
Qiankun Jin, Zheng Shigui, Gary Ding, Yianjun, Cui Binggui, Beijing Engeneering Software Technology Co. Ltd.; "3D Numerical Simulations of Penetration of Oil-Well Perforator into Concrete Targets", Paper for the 7th International LS-DYNA Users Conference, received Jan. 28, 2010, 6 pages.
Mario Dobrilovic, Zvonimir Ester, Trpimir Kujundzic; "Measurments of Shock Wave Force in Shock Tube with Indirect Methods", Original scientific paper vol. 17, str. 55-60, dated 2005, 6 pages.
IES, Scott A. Ager; "Model 64 and 74 Buildup", product presentation, dated Oct. 17, 2006,57 pages.
Patent Application, filed Dec. 17, 2010, serial No. PCT/US10/61104, 29 pages.
Drawings, filed Dec. 17, 2010, serial No. PCT/US10/61104, 10 figures, 9 pages.
Scott A. Ager; "IES Fast Speed Gauges", informational presentation, dated Mar. 2, 2009, 38 pages.

(56) References Cited

OTHER PUBLICATIONS

IES; "Battery Packing for High Shock", article AN102, received Sep. 1, 2010, 4 pages.
IES; "Accelerometer Wire Termination", article AN106, received Sep. 1, 2010, 4 pages.
John F. Schatz; "PulsFrac Validation: Owen/HTH Surface Block Test", product information, dated 2004, 4 pages.
John F. Schatz; "Casing Differential in PulsFrac Calculations", product information, dated 2004, 2 pages.
John F. Schatz; "The Role of Compressibility in PulsFrac Software", informational paper, dated Aug. 22, 2007, 2 pages.
Essca Group; "Erin Dynamic Flow Analysis Platform", online article, dated 2009, 1 page.
Halliburton; "Fast Gauge Recorder", article 5-110, received Nov. 16, 2010, 2 pages.
Kenji Furui; "A Comprehensive Skin Factor Model for Well Completions Based on Finite Element Simulations", informational paper, dated May 2004, 182 pages.
Halliburton; "Simulation Software for EquiFlow ICD Completions", H07010, dated Sep. 2009, 2 pages.
Advisory Action issued Nov. 27, 2013 for U.S. Appl. No. 113/210,303, 3 pages.
Office Action issued May 5, 2014 for U.S. Appl. No. 13/314,853, 55 pages.
Office Action issued Mar. 21, 2014 for U.S. Appl. No. 14/104,130, 19 pages.
Office Action issued Jul. 3, 2014 for U.S. Appl. No. 13/210,303, 23 pages.
Office Action issued Jun. 17, 2014 for Mexican application No. MX/a/2013/006898, 2 pages.
Office Action issued Jul. 28, 2014 for U.S. Appl. No. 13/314,853, 11 pages.

* cited by examiner

SENSING SHOCK DURING WELL PERFORATING

CROSS-REFERENCE TO RELATED APPLICATION

This application claims the benefit under 35 USC §119 of the filing date of International Application Serial No. PCT/US10/61102, filed 17 Dec. 2010. The entire disclosure of this prior application is incorporated herein by this reference.

BACKGROUND

The present disclosure relates generally to equipment utilized and operations performed in conjunction with a subterranean well and, in an embodiment described herein, more particularly provides for sensing shock during well perforating.

Attempts have been made to determine the effects of shock due to perforating on components of a perforating string. It would be desirable, for example, to prevent unsetting a production packer, to prevent failure of a perforating gun body, and to otherwise prevent or at least reduce damage to the various components of a perforating string.

Unfortunately, past attempts have not satisfactorily measured the strains, pressures, and/or accelerations, etc., produced by perforating. This makes estimations of conditions to be experienced by current and future perforating string designs unreliable.

Therefore, it will be appreciated that improvements are needed in the art. These improvements can be used, for example, in designing new perforating string components which are properly configured for the conditions they will experience in actual perforating situations.

SUMMARY

In carrying out the principles of the present disclosure, a shock sensing tool is provided which brings improvements to the art of measuring shock during well perforating. One example is described below in which the shock sensing tool is used to prevent damage to a perforating string. Another example is described below in which sensor measurements recorded by the shock sensing tool can be used to predict the effects of shock due to perforating on components of a perforating string.

A shock sensing tool for use with well perforating is described below. In one example, the shock sensing tool can include a generally tubular structure which is fluid pressure balanced, at least one sensor which senses load in the structure, and a pressure sensor which senses pressure external to the structure.

Also described below is a well system which can include a perforating string including multiple perforating guns and at least one shock sensing tool. The shock sensing tool can be interconnected in the perforating string between one of the perforating guns and at least one of: a) another of the perforating guns, and b) a firing head.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
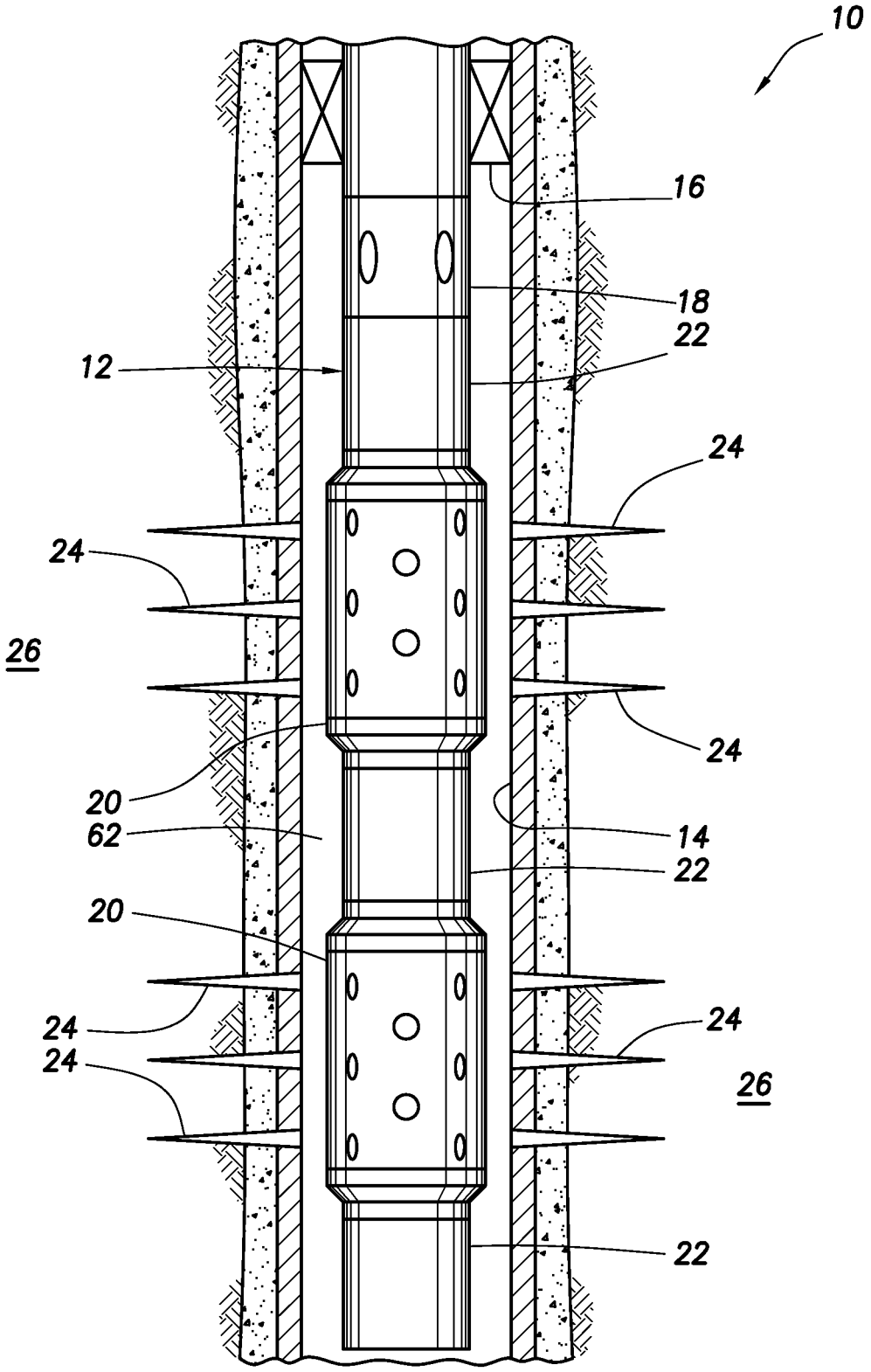
FIG. 1 is a schematic partial cross-sectional view of a well system and associated method which can embody principles of the present disclosure.

Representatively illustrated in FIG. 1 is a well system 10 and associated method which can embody principles of the present disclosure. In the well system 10, a perforating string 12 is installed in a wellbore 14. The depicted perforating string 12 includes a packer 16, a firing head 18, perforating guns 20 and shock sensing tools 22.

In other examples, the perforating string 12 may include more or less of these components. For example, well screens and/or gravel packing equipment may be provided, any number (including one) of the perforating guns 20 and shock sensing tools 22 may be provided, etc. Thus, it should be clearly understood that the well system 10 as depicted in FIG. 1 is merely one example of a wide variety of possible well systems which can embody the principles of this disclosure.

One advantage of interconnecting the shock sensing tools 22 below the packer 16 and in close proximity to the perforating guns 20 is that more accurate measurements of strain and acceleration at the perforating guns can be obtained. Pressure and temperature sensors of the shock sensing tools 22 can also sense conditions in the wellbore 14 in close proximity to perforations 24 immediately after the perforations are formed, thereby facilitating more accurate analysis of characteristics of an earth formation 26 penetrated by the perforations.

A shock sensing tool 22 interconnected between the packer 16 and the upper perforating gun 20 can record the effects of perforating on the perforating string 12 above the perforating guns. This information can be useful in preventing unsetting or other damage to the packer 16, firing head 18, etc., due to detonation of the perforating guns 20 in future designs.

A shock sensing tool 22 interconnected between perforating guns 20 can record the effects of perforating on the perforating guns themselves. This information can be useful in preventing damage to components of the perforating guns 20 in future designs.

A shock sensing tool 22 can be connected below the lower perforating gun 20, if desired, to record the effects of perforating at this location. In other examples, the perforating string 12 could be stabbed into a lower completion string, connected to a bridge plug or packer at the lower end of the perforating string, etc., in which case the information recorded by the lower shock sensing tool 22 could be useful in preventing damage to these components in future designs.

Viewed as a complete system, the placement of the shock sensing tools 22 longitudinally spaced apart along the perforating string 12 allows acquisition of data at various points in the system, which can be useful in validating a model of the system. Thus, collecting data above, between and below the guns, for example, can help in an understanding of the overall perforating event and its effects on the system as a whole.

The information obtained by the shock sensing tools 22 is not only useful for future designs, but can also be useful for current designs, for example, in post-job analysis, formation testing, etc. The applications for the information obtained by the shock sensing tools 22 are not limited at all to the specific examples described herein.

Figure 2:
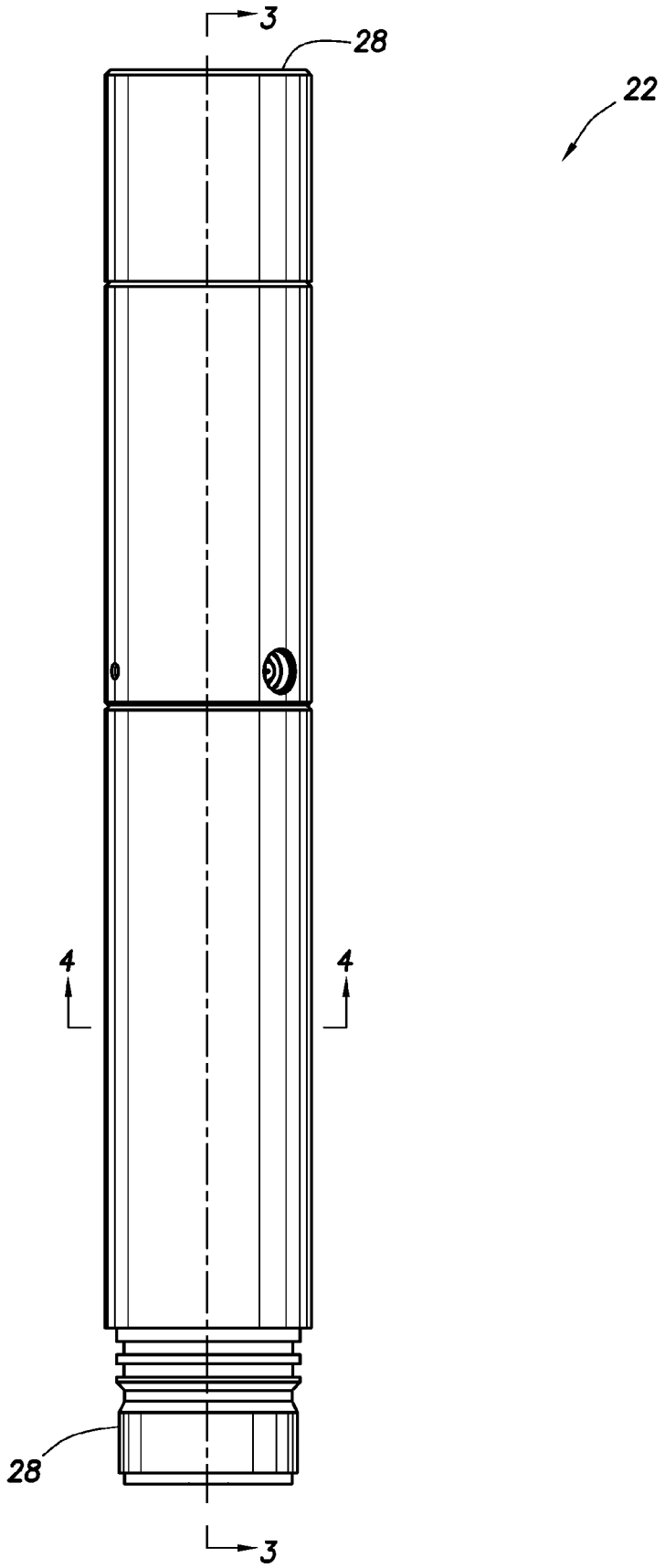
FIGS. 2-5 are schematic views of a shock sensing tool which may be used in the system and method of FIG. 1.

Referring additionally now to FIGS. 2-5, one example of the shock sensing tool 22 is representatively illustrated. As depicted in FIG. 2, the shock sensing tool 22 is provided with end connectors 28 (such as, perforating gun connectors, etc.)

for interconnecting the tool in the perforating string 12 in the well system 10. However, other types of connectors may be used, and the tool 22 may be used in other perforating strings and in other well systems, in keeping with the principles of this disclosure.

Figure 3:
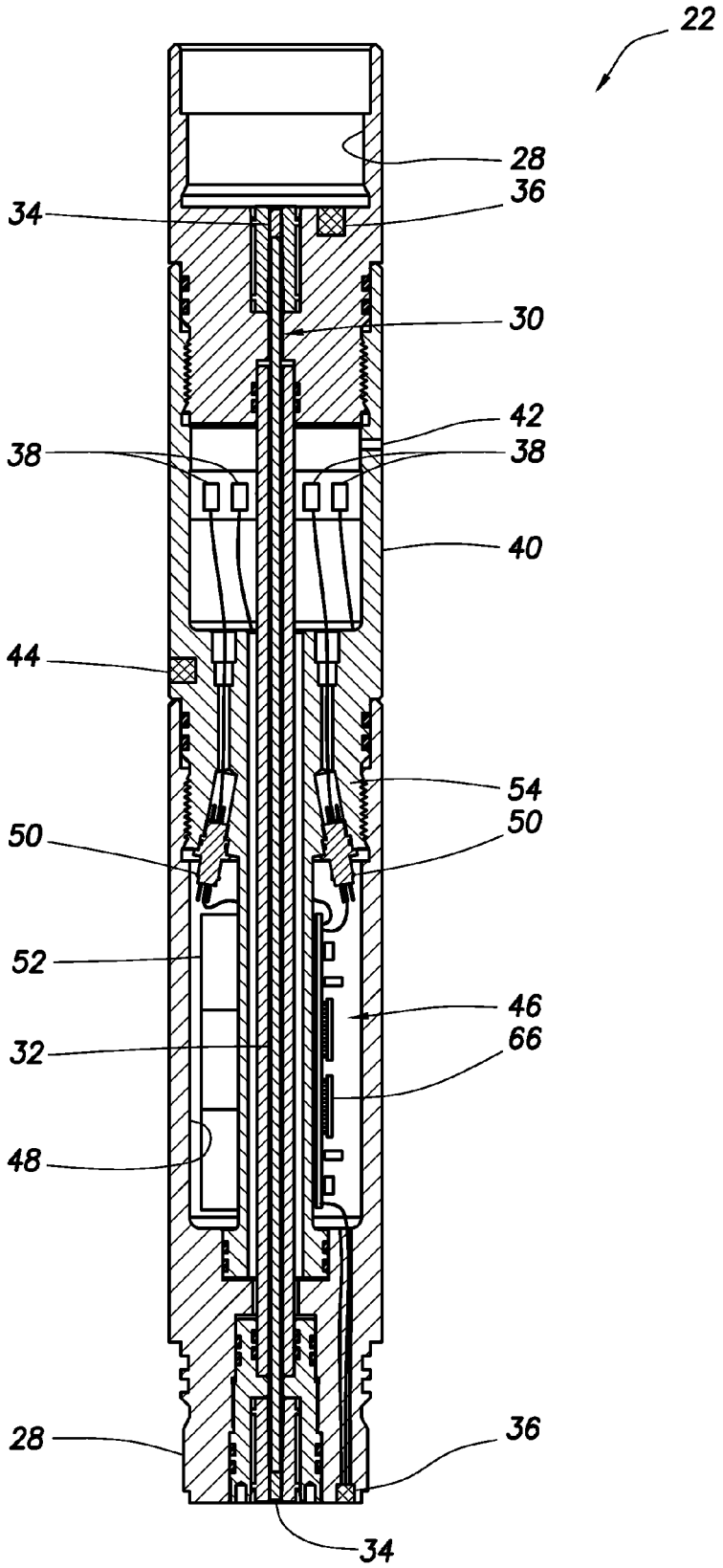

In FIG. 3, a cross-sectional view of the shock sensing tool 22 is representatively illustrated. In this view, it may be seen that the tool 22 includes a variety of sensors, and a detonation train 30 which extends through the interior of the tool.

The detonation train 30 can transfer detonation between perforating guns 20, between a firing head (not shown) and a perforating gun, and/or between any other explosive components in the perforating string 12. In the example of FIGS. 2-5, the detonation train 30 includes a detonating cord 32 and explosive boosters 34, but other components may be used, if desired.

One or more pressure sensors 36 may be used to sense pressure in perforating guns, firing heads, etc., attached to the connectors 28. Such pressure sensors 36 are preferably ruggedized (e.g., to withstand ~20000 g acceleration) and capable of high bandwidth (e.g., >20 kHz). The pressure sensors 36 are preferably capable of sensing up to ~60 ksi (~414 MPa) and withstanding ~175 degrees C. Of course, pressure sensors having other specifications may be used, if desired.

Strain sensors 38 are attached to an inner surface of a generally tubular structure 40 interconnected between the connectors 28. The structure 40 is preferably pressure balanced, i.e., with substantially no pressure differential being applied across the structure.

In particular, ports 42 are provided to equalize pressure between an interior and an exterior of the structure 40. In the simplest embodiment, the ports 42 are open to allow filling of structure 40 with wellbore fluid. However, the ports 42 are preferably plugged with an elastomeric compound and the structure 40 is preferably pre-filled with a suitable substance (such as silicone oil, etc.) to isolate the sensitive strain sensors 38 from wellbore contaminants. By equalizing pressure across the structure 40, the strain sensor 38 measurements are not influenced by any differential pressure across the structure before, during or after detonation of the perforating guns 20.

The strain sensors 38 are preferably resistance wire-type strain gauges, although other types of strain sensors (e.g., piezoelectric, piezoresistive, fiber optic, etc.) may be used, if desired. In this example, the strain sensors 38 are mounted to a strip (such as a KAPTON™ strip) for precise alignment, and then are adhered to the interior of the structure 40.

Preferably, four full Wheatstone bridges are used, with opposing 0 and 90 degree oriented strain sensors being used for sensing axial and bending strain, and +/−45 degree gauges being used for sensing torsional strain.

The strain sensors 38 can be made of a material (such as a KARMA™ alloy) which provides thermal compensation, and allows for operation up to ~150 degrees C. Of course, any type or number of strain sensors may be used in keeping with the principles of this disclosure.

The strain sensors 38 are preferably used in a manner similar to that of a load cell or load sensor. A goal is to have all of the loads in the perforating string 12 passing through the structure 40 which is instrumented with the sensors 38.

Having the structure 40 fluid pressure balanced enables the loads (e.g., axial, bending and torsional) to be measured by the sensors 38, without influence of a pressure differential across the structure. In addition, the detonating cord 32 is housed in a tube 33 which is not rigidly secured at one or both of its ends, so that it does not share loads with, or impart any loading to, the structure 40.

In other examples, the structure 40 may not be pressure balanced. A clean oil containment sleeve could be used with a pressure balancing piston. Alternatively, post-processing of data from an uncompensated strain measurement could be used in order to approximate the strain due to structural loads. This estimation would utilize internal and external pressure measurements to subtract the effect of the pressure loads on the strain gauges, as described for another configuration of the tool 22 below.

A temperature sensor 44 (such as a thermistor, thermocouple, etc.) can be used to monitor temperature external to the tool. Temperature measurements can be useful in evaluating characteristics of the formation 26, and any fluid produced from the formation, immediately following detonation of the perforating guns 20. Preferably, the temperature sensor 44 is capable of accurate high resolution measurements of temperatures up to ~170 degrees C.

Another temperature sensor (not shown) may be included with an electronics package 46 positioned in an isolated chamber 48 of the tool 22. In this manner, temperature within the tool 22 can be monitored, e.g., for diagnostic purposes or for thermal compensation of other sensors (for example, to correct for errors in sensor performance related to temperature change). Such a temperature sensor in the chamber 48 would not necessarily need the high resolution, responsiveness or ability to track changes in temperature quickly in wellbore fluid of the other temperature sensor 44.

The electronics package 46 is connected to at least the strain sensors 38 via pressure isolating feed-throughs or bulkhead connectors 50. Similar connectors may also be used for connecting other sensors to the electronics package 46. Batteries 52 and/or another power source may be used to provide electrical power to the electronics package 46.

The electronics package 46 and batteries 52 are preferably ruggedized and shock mounted in a manner enabling them to withstand shock loads with up to ~10000 g acceleration. For example, the electronics package 46 and batteries 52 could be potted after assembly, etc.

Figure 4:
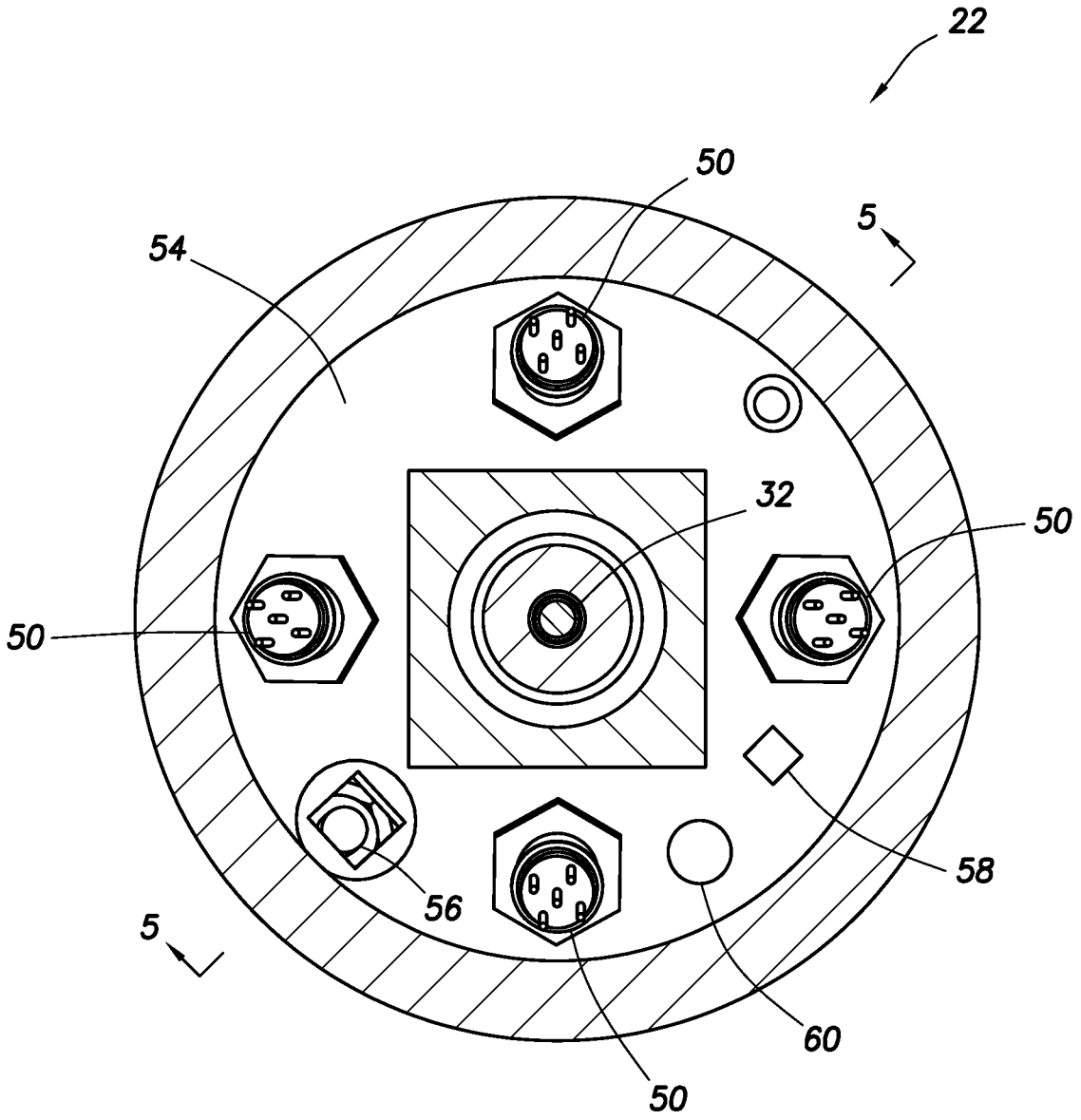

In FIG. 4 it may be seen that four of the connectors 50 are installed in a bulkhead 54 at one end of the structure 40. In addition, a pressure sensor 56, a temperature sensor 58 and an accelerometer 60 are preferably mounted to the bulkhead 54.

The pressure sensor 56 is used to monitor pressure external to the tool 22, for example, in an annulus 62 formed radially between the perforating string 12 and the wellbore 14 (see FIG. 1). The pressure sensor 56 may be similar to the pressure sensors 36 described above. A suitable pressure transducer is the Kulite model HKM-15-500.

The temperature sensor 58 may be used for monitoring temperature within the tool 22. This temperature sensor 58 may be used in place of, or in addition to, the temperature sensor described above as being included with the electronics package 46.

The accelerometer 60 is preferably a piezoresistive type accelerometer, although other types of accelerometers may be used, if desired. Suitable accelerometers are available from Endevco and PCB (such as the PCB 3501A series, which is available in single axis or triaxial packages, capable of sensing up to ~60000 g acceleration).

Figure 5:
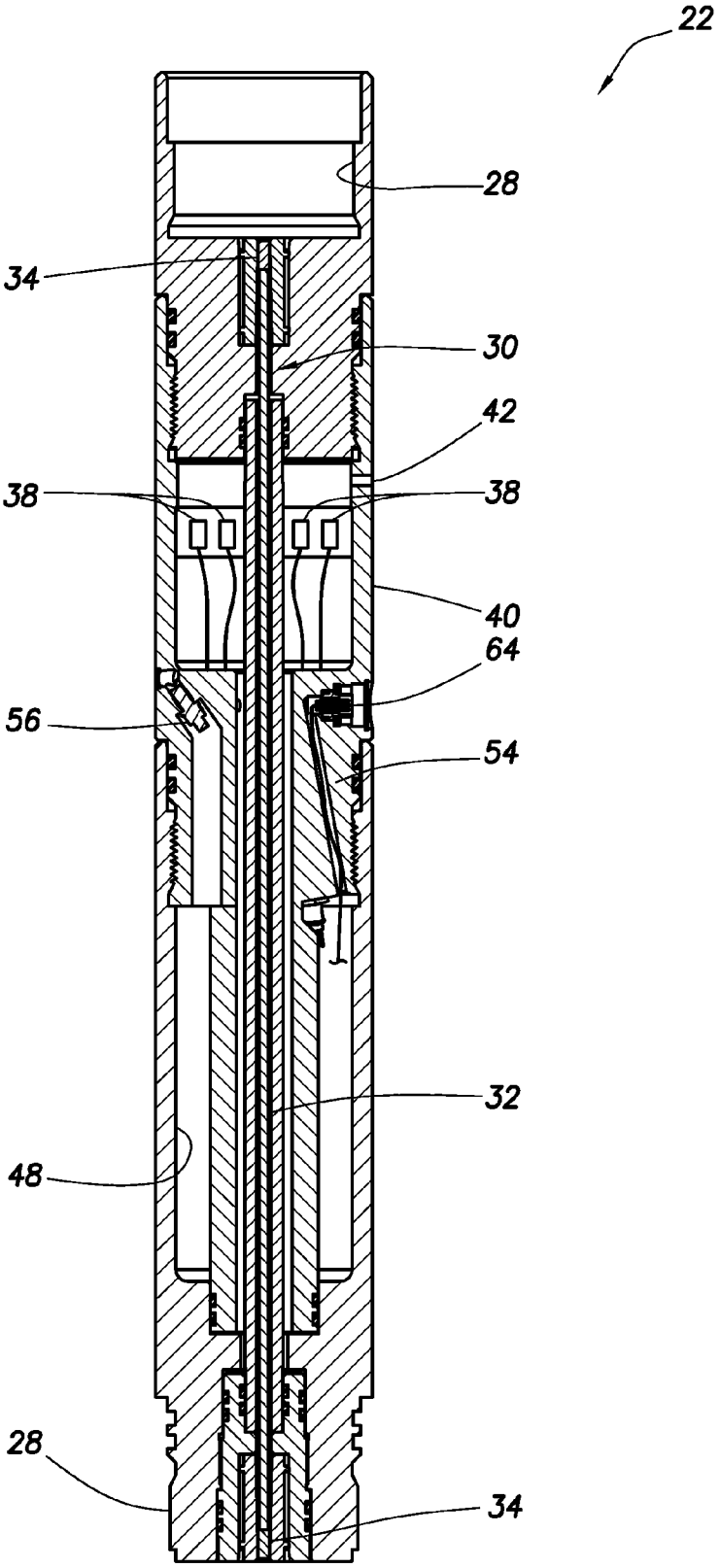

In FIG. 5, another cross-sectional view of the tool 22 is representatively illustrated. In this view, the manner in which the pressure transducer 56 is ported to the exterior of the tool 22 can be clearly seen. Preferably, the pressure transducer 56 is close to an outer surface of the tool, so that distortion of measured pressure resulting from transmission of pressure waves through a long narrow passage is prevented.

Also visible in FIG. 5 is a side port connector 64 which can be used for communication with the electronics package 46 after assembly. For example, a computer can be connected to the connector 64 for powering the electronics package 46, extracting recorded sensor measurements from the electronics package, programming the electronics package to respond to a particular signal or to "wake up" after a selected time, otherwise communicating with or exchanging data with the electronics package, etc.

Note that it can be many hours or even days between assembly of the tool 22 and detonation of the perforating guns 20. In order to preserve battery power, the electronics package 46 is preferably programmed to "sleep" (i.e., maintain a low power usage state), until a particular signal is received, or until a particular time period has elapsed.

The signal which "wakes" the electronics package 46 could be any type of pressure, temperature, acoustic, electromagnetic or other signal which can be detected by one or more of the sensors 36, 38, 44, 56, 58, 60. For example, the pressure sensor 56 could detect when a certain pressure level has been achieved or applied external to the tool 22, or when a particular series of pressure levels has been applied, etc. In response to the signal, the electronics package 46 can be activated to a higher measurement recording frequency, measurements from additional sensors can be recorded, etc.

As another example, the temperature sensor 58 could sense an elevated temperature resulting from installation of the tool 22 in the wellbore 14. In response to this detection of elevated temperature, the electronics package 46 could "wake" to record measurements from more sensors and/or higher frequency sensor measurements.

As yet another example, the strain sensors 38 could detect a predetermined pattern of manipulations of the perforating string 12 (such as particular manipulations used to set the packer 16). In response to this detection of pipe manipulations, the electronics package 46 could "wake" to record measurements from more sensors and/or higher frequency sensor measurements.

The electronics package 46 depicted in FIG. 3 preferably includes a non-volatile memory 66 so that, even if electrical power is no longer available (e.g., the batteries 52 are discharged), the previously recorded sensor measurements can still be downloaded when the tool 22 is later retrieved from the well. The non-volatile memory 66 may be any type of memory which retains stored information when powered off. This memory 66 could be electrically erasable programmable read only memory, flash memory, or any other type of non-volatile memory. The electronics package 46 is preferably able to collect and store data in the memory 66 at >100 kHz sampling rate.

Figure 6:
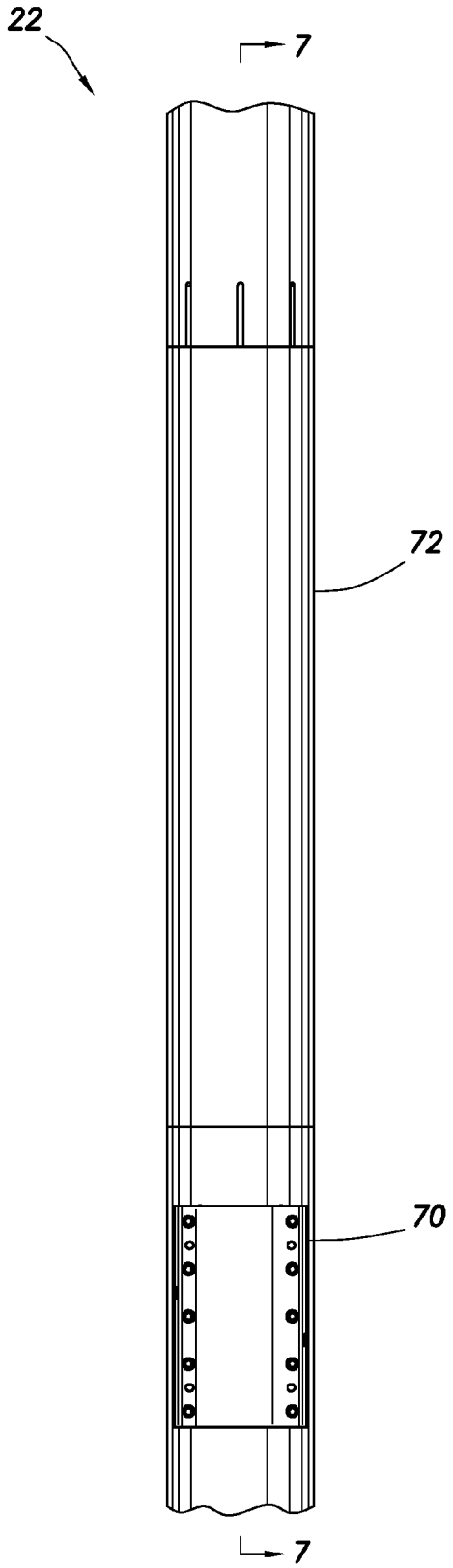
FIGS. 6-8 are schematic views of another configuration of the shock sensing tool.
Figure 7:
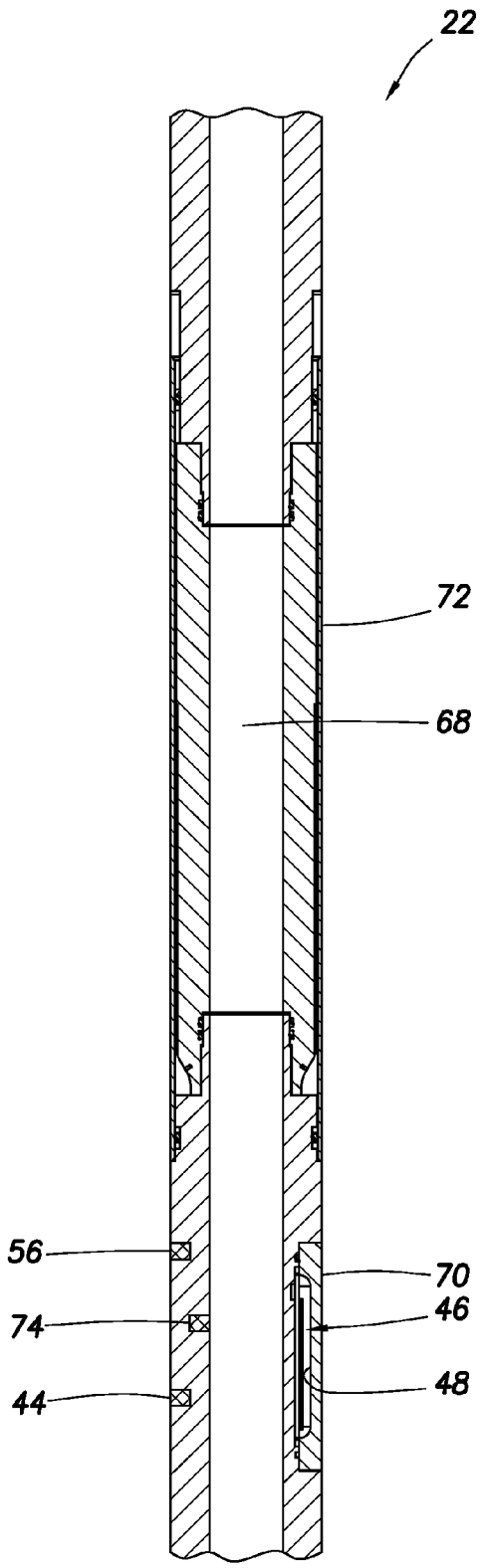
Figure 8:
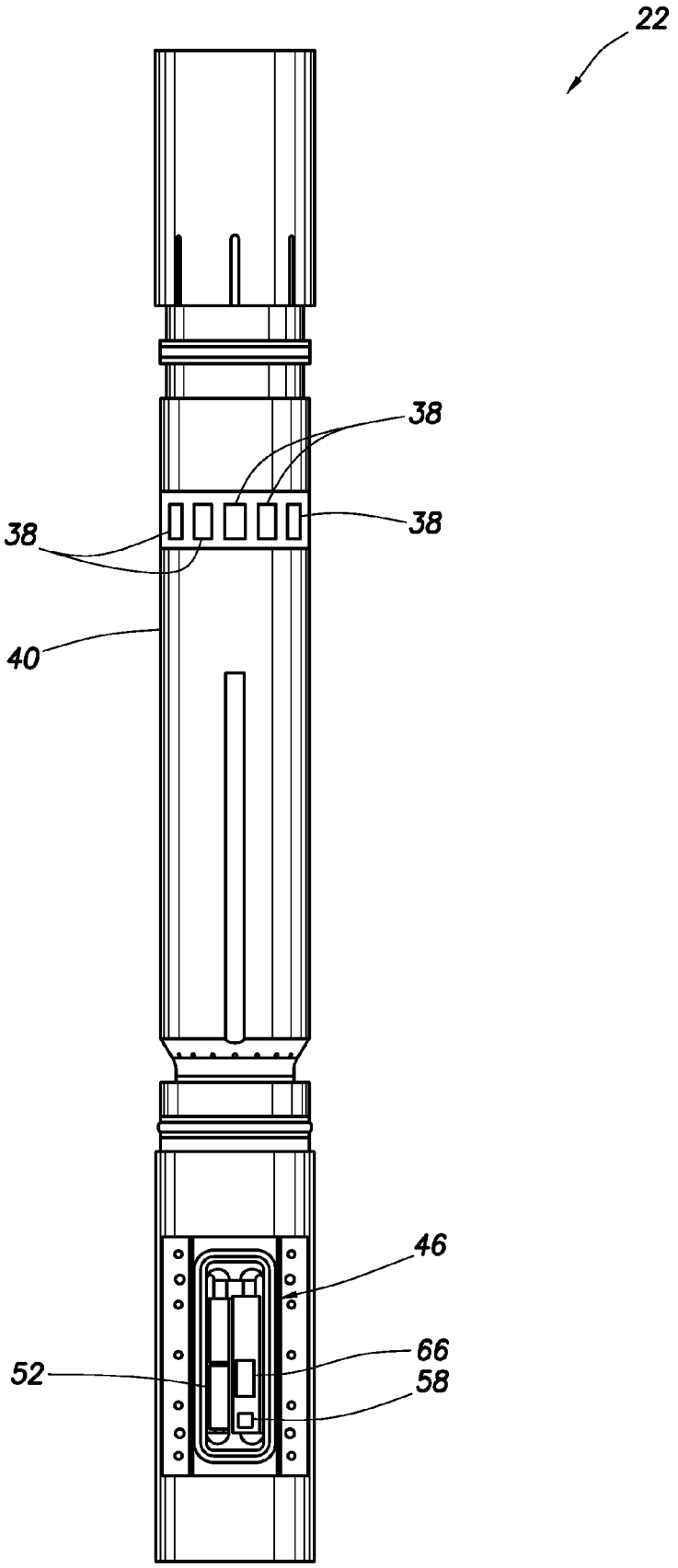

Referring additionally now to FIGS. 6-8, another configuration of the shock sensing tool 22 is representatively illustrated. In this configuration, a flow passage 68 (see FIG. 7) extends longitudinally through the tool 22. Thus, the tool 22 may be especially useful for interconnection between the packer 16 and the upper perforating gun 20, although the tool 22 could be used in other positions and in other well systems in keeping with the principles of this disclosure.

In FIG. 6 it may be seen that a removable cover 70 is used to house the electronics package 46, batteries 52, etc. In FIG. 8, the cover 70 is removed, and it may be seen that the temperature sensor 58 is included with the electronics package 46 in this example. The accelerometer 60 could also be part of the electronics package 46, or could otherwise be located in the chamber 48 under the cover 70.

A relatively thin protective sleeve 72 is used to prevent damage to the strain sensors 38, which are attached to an exterior of the structure 40 (see FIG. 8, in which the sleeve is removed, so that the strain sensors are visible). Although in this example the structure 40 is not pressure balanced, another pressure sensor 74 (see FIG. 7) can be used to monitor pressure in the passage 68, so that any contribution of the pressure differential across the structure 40 to the strain sensed by the strain sensors 38 can be readily determined (e.g., the effective strain due to the pressure differential across the structure 40 is subtracted from the measured strain, to yield the strain due to structural loading alone).

Note that there is preferably no pressure differential across the sleeve 72, and a suitable substance (such as silicone oil, etc.) is preferably used to fill the annular space between the sleeve and the structure 40. The sleeve 72 is not rigidly secured at one or both of its ends, so that it does not share loads with, or impart loads to, the structure 40.

Any of the sensors described above for use with the tool 22 configuration of FIGS. 2-5 may also be used with the tool configuration of FIGS. 6-8.

In general, it is preferable for the structure 40 (in which loading is measured by the strain sensors 38) to experience dynamic loading due only to structural shock by way of being pressure balanced, as in the configuration of FIGS. 2-5. However, other configurations are possible in which this condition can be satisfied. For example, a pair of pressure isolating sleeves could be used, one external to, and the other internal to, the load bearing structure 40 of the FIGS. 6-8 configuration. The sleeves could encapsulate air at atmospheric pressure on both sides of the structure 40, effectively isolating the structure 40 from the loading effects of differential pressure. The sleeves should be strong enough to withstand the pressure in the well, and may be sealed with o-rings or other seals on both ends. The sleeves may be structurally connected to the tool at no more than one end, so that a secondary load path around the strain sensors 38 is prevented.

Although the perforating string 12 described above is of the type used in tubing-conveyed perforating, it should be clearly understood that the principles of this disclosure are not limited to tubing-conveyed perforating. Other types of perforating (such as, perforating via coiled tubing, wireline or slickline, etc.) may incorporate the principles described herein. Note that the packer 16 is not necessarily a part of the perforating string 12.

It may now be fully appreciated that the above disclosure provides several advancements to the art. In the example of the shock sensing tool 22 described above, the effects of perforating can be conveniently measured in close proximity to the perforating guns 20.

In particular, the above disclosure provides to the art a well system 10 which can comprise a perforating string 12 including multiple perforating guns 20 and at least one shock sensing tool 22. The shock sensing tool 22 can be interconnected in the perforating string 12 between one of the perforating guns 20 and at least one of: a) another of the perforating guns 20, and b) a firing head 18.

The shock sensing tool 22 may be interconnected in the perforating string 12 between the firing head 18 and the perforating guns 20.

The shock sensing tool 22 may be interconnected in the perforating string 12 between two of the perforating guns 20.

Multiple shock sensing tools 22 can be longitudinally distributed along the perforating string 12.

At least one of the perforating guns 20 may be interconnected in the perforating string 12 between two of the shock sensing tools 22.

A detonation train 30 may extend through the shock sensing tool 22.

The shock sensing tool 22 can include a strain sensor 38 which senses strain in a structure 40. The structure 40 may be fluid pressure balanced.

The shock sensing tool 22 can include a sensor 38 which senses load in a structure 40. The structure 40 may transmit all structural loading between the one of the perforating guns 20 and at least one of: a) the other of the perforating guns 20, and b) the firing head 18.

Both an interior and an exterior of the structure 40 may be exposed to pressure in an annulus 62 between the perforating string 12 and a wellbore 14. The structure 40 may be isolated from pressure in the wellbore 14.

The shock sensing tool 22 can include a pressure sensor 56 which senses pressure in an annulus 62 formed between the shock sensing tool 22 and a wellbore 14.

The shock sensing tool 22 can include a pressure sensor 36 which senses pressure in one of the perforating guns 20.

The shock sensing tool 22 may begin increased recording of sensor measurements in response to sensing a predetermined event.

Also described by the above disclosure is a shock sensing tool 22 for use with well perforating. The shock sensing tool 22 can include a generally tubular structure 40 which is fluid pressure balanced, at least one sensor 38 which senses load in the structure 40 and a pressure sensor 56 which senses pressure external to the structure 40.

The at least one sensor 38 may comprise a combination of strain sensors which sense axial, bending and torsional strain in the structure 40.

The shock sensing tool 22 can also include another pressure sensor 36 which senses pressure in a perforating gun 20 attached to the shock sensing tool 22.

The shock sensing tool 22 can include an accelerometer 60 and/or a temperature sensor 44, 58.

A detonation train 30 may extend through the structure 40.

A flow passage 68 may extend through the structure 40.

The shock sensing tool 22 may include a perforating gun connector 28 at an end of the shock sensing tool 22.

The shock sensing tool 22 may include a non-volatile memory 66 which stores sensor measurements.

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a perforating string including multiple perforating guns and at least one shock sensing tool which measures shock experienced by the perforating string due to detonation of the perforating guns and which stores within the shock sensing tool at least one measurement of the shock, wherein the shock sensing tool is interconnected in the perforating string between a firing head and a perforating gun nearest the firing head, wherein the firing head detonates the nearest perforating gun.

2. The well system of claim 1, wherein multiple shock sensing tools are longitudinally distributed along the perforating string.

3. The well system of claim 1, wherein at least one of the perforating guns is interconnected in the perforating string between two shock sensing tools.

4. The well system of claim 1, wherein a detonation train extends through the shock sensing tool.

5. The well system of claim 1, wherein the shock sensing tool includes a strain sensor which senses strain in a structure, and wherein the structure is fluid pressure balanced.

6. A well system, comprising:

a perforating string including multiple perforating guns and at least one shock sensing tool which measures shock experienced by the perforating string due to detonation of the perforating guns and which stores within the shock sensing tool at least one measurement of the shock, the shock sensing tool being interconnected in the perforating string between a firing head and a perforating gun nearest the firing head, wherein the firing head detonates the nearest perforating gun, and wherein the shock sensing tool includes a sensor which senses load in a structure.

7. The system of claim 6, wherein the structure transmits all structural loading between the nearest perforating gun and the firing head.

8. The system of claim 6, wherein the structure is fluid pressure balanced.

9. The system of claim 8, wherein both an interior and an exterior of the structure are exposed to pressure in an annulus between the perforating string and a wellbore.

10. The system of claim 6, wherein the structure is isolated from pressure in a wellbore.

11. A well system, comprising:

a perforating string including multiple perforating guns and at least one shock sensing tool which measures shock experienced by the perforating string due to detonation of the perforating guns and which stores within the shock sensing tool at least one measurement of the shock, the shock sensing tool being interconnected in the perforating string between a firing head and a perforating gun nearest the firing head, wherein the firing head detonates the nearest perforating gun, and wherein the shock sensing tool includes a pressure sensor which senses pressure produced by detonating at least one of the perforating guns.

12. A well system, comprising:

a perforating string including multiple perforating guns and at least one shock sensing tool which measures shock experienced by the perforating string due to detonation of the perforating guns and which stores within the shock sensing tool at least one measurement of the shock, the shock sensing tool being interconnected in the perforating string between a firing head and a perforating gun nearest the firing head, wherein the firing head detonates the nearest perforating gun, and wherein the shock sensing tool begins increased recording of sensor measurements in response to sensing a predetermined event.

13. A shock sensing tool for use with well perforating, the shock sensing tool comprising:

a structure which is fluid pressure balanced;

at least one sensor which senses load in the structure;

a first pressure sensor which senses pressure external to the structure;

an electronics package which collects sensor measurements of shock experienced due to detonation of at least one perforating gun and which stores downhole the sensor measurements; and at least one perforating gun connector which interconnects the shock sensing tool in a perforating string between a firing head and a perforating gun nearest the firing head, wherein the firing head detonates the nearest perforating gun.

14. The shock sensing tool of claim 13, wherein the at least one sensor comprises a combination of strain sensors which senses axial, bending and torsional strain in the structure.

15. The shock sensing tool of claim 13, further comprising a second pressure sensor which senses pressure internal to the structure.

16. The shock sensing tool of claim 13, further comprising an accelerometer.

17. The shock sensing tool of claim 13, further comprising a temperature sensor.

18. The shock sensing tool of claim 13, wherein the shock sensing tool begins increased recording of the sensor measurements in response to sensing a predetermined event.

19. The shock sensing tool of claim 13, wherein a detonation train extends through the structure.

20. The shock sensing tool of claim 13, wherein a flow passage extends through the structure.

21. The shock sensing tool of claim 13, further comprising a non-volatile memory which stores the sensor measurements.

* * * * *